US006299256B1

(12) United States Patent
Wyatt

(10) Patent No.: US 6,299,256 B1
(45) Date of Patent: Oct. 9, 2001

(54) METHOD AND APPARATUS FOR RECOVERING A GAS FROM A GAS HYDRATE LOCATED ON THE OCEAN FLOOR

(75) Inventor: Douglas E. Wyatt, Aiken, SC (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 09/571,401

(22) Filed: May 15, 2000

(51) Int. Cl.[7] ..... E21C 50/00; E02F 7/00
(52) U.S. Cl. ..... 299/8; 299/9
(58) Field of Search ..... 299/9, 8; 166/335; 37/307, 313

(56) References Cited

U.S. PATENT DOCUMENTS 3,748,248 * 7/1973 Wanzenberg et al. ..... 204/208
4,053,181 * 10/1977 Saito ..... 299/9
4,376,462 * 3/1983 Elliott et al. ..... 166/267
4,480,569 * 11/1984 van der Veen et al. ..... 114/74 T
5,431,483 * 7/1995 Zaiger ..... 299/9
5,950,732 * 9/1999 Agee et al. ..... 166/354
5,970,635 * 10/1999 Wilmoth ..... 37/323
6,178,670 * 1/2001 Susman et al. ..... 37/313
6,209,965 * 4/2001 Borns et al. ..... 299/8

* cited by examiner

*Primary Examiner*—Hoang Dang
(74) *Attorney, Agent, or Firm*—James C. Durkis; Virginia B. Caress; Paul A. Gottlieb

(57) ABSTRACT

A method and apparatus for recovering a gas from a gas hydrate on the ocean floor includes a flexible cover, a plurality of steerable base members secured to the cover, and a steerable mining module. A suitable source for inflating the cover over the gas hydrate deposit is provided. The mining module, positioned on the gas hydrate deposit, is preferably connected to the cover by a control cable. A gas retrieval conduit or hose extends upwardly from the cover to be connected to a support ship on the ocean surface.

17 Claims, 1 Drawing Sheet

METHOD AND APPARATUS FOR RECOVERING A GAS FROM A GAS HYDRATE LOCATED ON THE OCEAN FLOOR

This invention was made with Government support under contract No. DE-AC09-96SR18500 awarded by the U.S. Department of Energy. The Government has certain rights in the invention.

FIELD AND HISTORICAL BACKGROUND OF THE INVENTION

The present invention is directed to recovering a gas from the ocean floor, and more particularly to a method and apparatus for mining, extracting and recovering methane gas from methane hydrate formations located on the ocean floor.

Gas hydrates are crystalline substances composed of water and gas, mainly containing methane, where a solid-water lattice encloses the gas molecules in a cage-like structure, or clathrate. Methane hydrates are predominantly found on the ocean floor around the continental margins. They are found to exist because of cold, high-pressure deep-water conditions. Methane hydrates are a potential source for fuel energy. However, the geological distribution and availability of this material is still under study while methods to recover the resource are only beginning to be considered.

Although methane hydrates are abundantly found in nature, its implications as a source of energy and impact on the environment have not yet been sufficiently understood. As a result, the recovery of methane from the gas hydrates has not yet been fully explored. Although a few techniques for mining and recovery of gas hydrates are conventionally utilized, these techniques are not filly satisfactory.

In view of the above, there is a need for providing a simple technique to extract gas hydrates with a minimum of environmental damage and technological need.

OBJECTS AND SUMMARY OF THE INVENTION

The principal object of the present invention is to provide a method and apparatus for recovering a gas from a gas hydrate formation located on the ocean floor that causes minimum adverse environmental implications.

Another object of the present invention is to provide a method and apparatus for recovering a gas from a gas hydrate located on the ocean floor that does not require advanced or sophisticated technological know-how and equipment.

Yet another object of the present invention is to provide a method and apparatus for recovering methane as a source of fuel or energy for use in various industries.

In accordance with the invention, an apparatus is provided which includes a flexible cover, a plurality of steerable base members secured to the cover, and a steerable mining module. A suitable source for inflating the cover over the gas hydrate deposit is provided. The mining module, positioned on the gas hydrate deposit, is preferably connected to the cover by a control cable. A gas retrieval conduit or hose extends upwardly from the cover to be connected to a support ship on the ocean surface.

BRIEF DESCRIPTION OF THE DRAWINGS

The above and other objects, novel features and advantages of the present invention will become apparent from the following detailed description of the invention as illustrated in the drawings, in which.

DETAILED DESCRIPTION OF THE INVENTION

Figure 1:
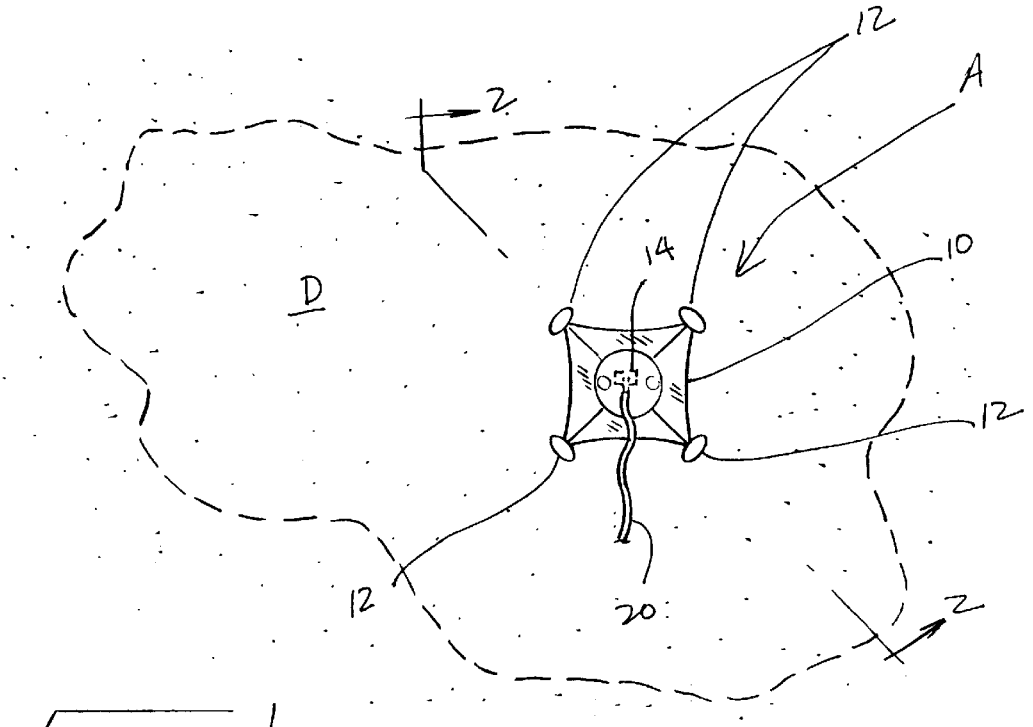
FIG. 1 is a top plan view of the apparatus of the present invention.
Figure 2:
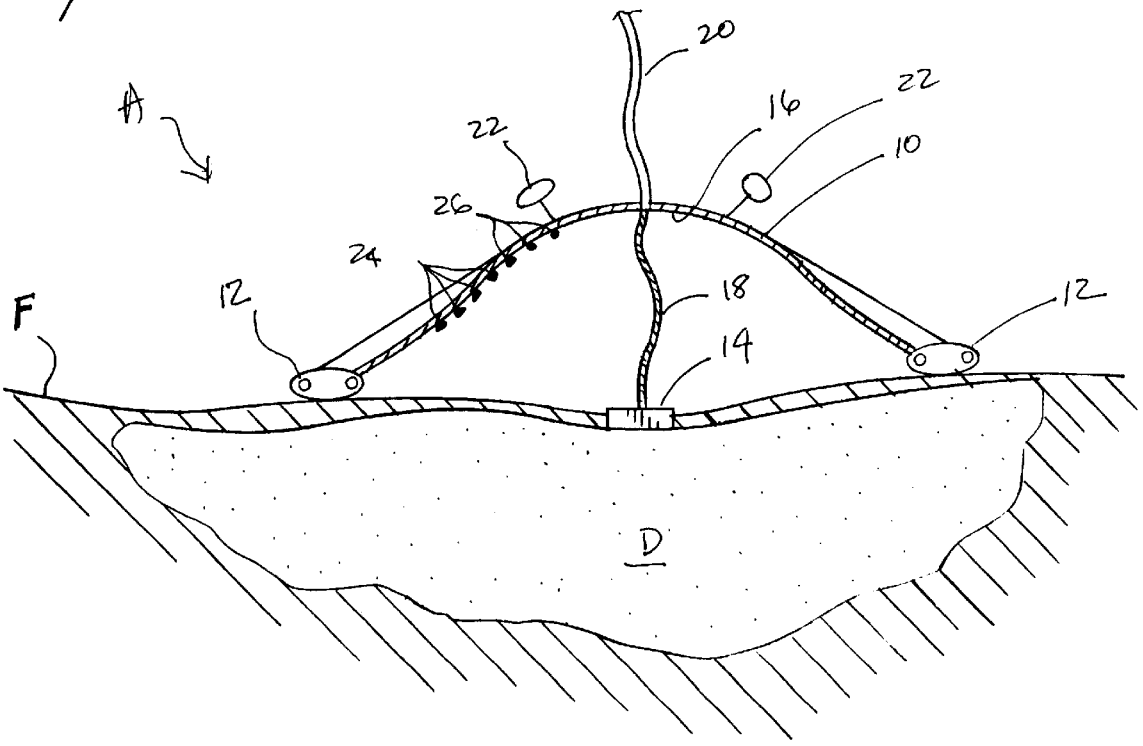
FIG. 2 is an enlarged cross-sectional view taken along line 2—2 of FIG. 1.

As best shown in FIGS. 1–2, the apparatus A of the present invention includes a generally flexible cover 10 made of a suitable material, such as Mylar®, Kevlar®, canvas, plastic, or similar material The cover 10 has the configuration of a "circus tent", and includes four pods or base members 12, one at each corner thereof The pods 12 are steerable, directionally and ballast controlled to maintain the cover 10 spread over a gas hydrate deposit D. The pods 12 further allow the cover 10 to retain a desired, inflated shape and to move the entire apparatus A laterally and vertically along the sea floor F. Although not shown, the apparatus A would be remotely controlled by a support ship or similar vessel on the surface.

As best shown in FIG. 2, a mining module 14 is connected to the inside surface 16 of the cover 10 by a control cable 18. The mining module 14 is configured so as to hover over and sink into the hydrate deposit D to dislodge the deposit D by mechanically agitating and/or heating and thawing. A gas retrieval hose or conduit 20 extends upwardly from the cover 10 to the support ship. As shown in FIG. 2, preferably two air sources 22 are provided to maintain a proper, and preferably arcuate, inflation of the cover 10. There are provided, preferably on the inside 16 of the cover 10, gas detectors 24 and inflation sensors 26.

Although not shown, the mining module 14 would contain heated, mechanical or hydraulic agitators to agitate, dislodge and/or thaw gas hydrate D, preferably by using water jets.

USE AND OPERATION

The mining is accomplished by submerging the apparatus A into the water and above a gas hydrate deposit D. The agitators in the module 14 are then activated to dislodge or thaw the gas deposit D. Since the mining module 14 is considerably smaller than the cover 10, the gas generated from the deposit D is extracted and safely contained within the cover. The cover 10 further helps to contain any adverse effects on the surrounding environment due to mining within the covered area. The gas generated from the deposit is collected in the cover 10 and allowed to flow by buoyancy through the gas hose 20 to a storage unit on the surface (not shown). Since the entire apparatus A operates as a unit, it can be easily moved, as necessary, to adequately mine, extract and recover the gas from the deposit D.

While this invention has been described as having preferred ranges, steps, materials, or a design, it is understood that it is capable of further modifications, uses and/or adaptations of the invention following in general the principle of the invention, and including such departures from the present disclosure, as those come within the known or customary practice in the art to which the invention pertains and as may be applied to the central features hereinbefore set forth, and fall within the scope of the invention and of the appended claims. It is further understood that the present invention is not linked to the claims appended hereto.

What is claimed is:

1. An apparatus for recovering a gas from a gas hydrate located on the ocean floor, comprising:

a flexible cover;

a plurality of steerable base members operably secured to said cover;

a steerable mining module for operably cooperating with said cover;

means for inflating said cover; and a gas retrieval conduit operably connected with said cover.

2. The apparatus of claim 1, wherein:

said cover is made of a material selected from the group consisting of Mylar, Kevlar, canvas and plastic.

3. The apparatus of claim 1, wherein:

said steerable base members are ballast controlled.

4. The apparatus of claim 1, wherein:

said steerable mining module is ballast controlled.

5. The apparatus of claim 1, wherein:

said steerable mining module includes means for agitating the gas hydrate.

6. The apparatus of claim 5, wherein:

said agitating means comprises heated, mechanical or hydraulic agitators.

7. The apparatus of claim 1, further comprising:

a control cable connecting said module with said cover.

8. The apparatus of claim 1, further comprising:

at least one gas detector for monitoring the gas generated from the gas hydrate.

9. The apparatus of claim 1, further comprising:

at least one sensor for monitoring the inflation of said cover.

10. An apparatus for recovering a gas from a gas hydrate located on the ocean floor, comprising:

a flexible cover;

a plurality of steerable base members, each operably secured to said cover at a comer thereof;

a steerable mining module for operably cooperating with said cover;

a control cable connecting said mining module with the inside of said cover;

means for inflating said cover; and a gas retrieval conduit extending vertically upwardly from said cover.

11. A method of recovering a gas from a gas hydrate located on the ocean floor, comprising the steps of:

positioning and inflating a flexible cover over a gas hydrate;

positioning a mining module under said cover and over the gas hydrate, the mining module including means for agitating the gas hydrate;

activating the agitating means for thawing the gas hydrate; and recovering the gas from the thawed gas hydrate.

12. The method of claim 11, wherein:

the mining module is ballast controlled.

13. The method of claim 11, wherein:

the cover includes means for inflating and maintaining a generally arcuate inflation of the cover.

14. The method of claim 11, wherein:

the agitating means comprises heated, mechanical or hydraulic agitators.

15. The method of claim 11, further comprising the step of:

collecting the gas generated from the gas hydrate within the cover.

16. The method of claim 15, further comprising the step of:

allowing the collected gas to flow upwardly to a storage unit.

17. The method of claim 11, wherein:

the mining module is submerged in the gas hydrate.

* * * * *